US007313845B2

(12) United States Patent
Nam

(10) Patent No.: US 7,313,845 B2
(45) Date of Patent: Jan. 1, 2008

(54) UPRIGHT TYPE CLEANER

(75) Inventor: Hyeun Sik Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 669 days.

(21) Appl. No.: 10/841,529

(22) Filed: May 10, 2004

(65) Prior Publication Data

US 2005/0138767 A1 Jun. 30, 2005

(30) Foreign Application Priority Data

Dec. 24, 2003 (KR) ..... 10-2003-0096857

(51) Int. Cl.
*A47L 9/28* (2006.01)

(52) U.S. Cl. ..... 15/339; 15/351; 15/410; 15/DIG. 10

(58) Field of Classification Search ..... 15/347, 15/350–353, 339, 410, DIG. 10
See application file for complete search history.

(56) References Cited

U.S. PATENT DOCUMENTS

| | | | | |
|---|---|---|---|---|
| 1,192,949 | A * | 8/1916 | Spangler | 15/410 |
| 1,356,663 | A | 10/1920 | Spielman | |
| 1,447,814 | A * | 3/1923 | Paulus | 200/61.85 |
| 2,148,656 | A | 2/1939 | Smellie | |
| 2,221,746 | A * | 11/1940 | Kirby | 15/351 |
| 2,534,479 | A * | 12/1950 | Sellers | 15/319 |
| 3,217,351 | A * | 11/1965 | Hayba | 15/324 |
| 3,715,775 | A | 2/1973 | Nickelson | |
| 4,686,736 | A * | 8/1987 | Petralia et al. | 15/332 |
| 5,353,471 | A * | 10/1994 | Guhne et al. | 15/339 |
| 6,351,872 | B1 | 3/2002 | McCormick | |
| 2004/0134018 | A1 * | 7/2004 | Conner et al. | 15/339 |

FOREIGN PATENT DOCUMENTS

| | | |
|---|---|---|
| GB | 162777 | 5/1921 |
| GB | 723686 | 2/1955 |
| GB | 910813 | 11/1962 |
| GB | 928047 | 6/1963 |
| GB | 2 321 393 A | 7/1998 |
| JP | 4-12720 | 1/1992 |
| JP | 5-76467 A | 3/1993 |

* cited by examiner

*Primary Examiner*—Theresa T. Snider
(74) *Attorney, Agent, or Firm*—Birch, Stewart, Kolasch & Birch, LLP

(57) ABSTRACT

An upright type cleaner comprises: a body provided with a handgrip at an upper side thereof; a suction head positioned at a lower side of the body and hinge-connected to the body, for sucking dust and foreign materials of a floor; and a power ON/OFF unit disposed between the body and the suction head for turning off a power when the body is uprighted and turning on the power when the body is inclined. According to this, the power is automatically turned on without a user's additional handle at the time of performing a cleaning and the power is automatically turned off at the time of completing the cleaning, thereby increasing the user's convenience.

6 Claims, 5 Drawing Sheets

UPRIGHT TYPE CLEANER

This Non-provisional application claims priority under 35 U.S.C. § 119(a) on Patent Application No(s). 10-2003-0096857 filed in Korea on Dec. 24, 2003, the entire contents of which are hereby incorporated by reference.

BACKGROUND OF THE INVENTION

1. Field of the Invention

The present invention relates to an upright type cleaner, and more particularly, to an upright type cleaner capable of more conveniently handling a power switch.

2. Description of the Conventional Art

FIG. 1 is a perspective view showing an upright type cleaner in accordance with the conventional art.

The conventional upright type cleaner comprises: a body 102 uprightly arranged; a suction head 104 hinge-connected to a lower side of the body 102 for sucking dust or foreign materials of a floor; and a handgrip 106 detachably mounted at an upper side of the body 102 for a user to grip.

A suction motor (not shown) for generating a suction force, a filter (not shown) for collecting dust or foreign materials by a suction force generated from the suction motor, and etc. are mounted in the body 102.

A moving wheel 108 is mounted at a lower side of the suction head 104, and a suction hose 110 for guiding dust and foreign materials sucked through the suction head 104 to the filter is connected between the body 102 and the suction head 104.

A power switch 120 for powering ON/OFF a power of the cleaner is mounted at an upper side of the body 102, and an electric wire 126 to which a socket outlet 128 for connecting a power by being inserted into a plug (not shown) is connected is wound on a supporter 124 formed between the body 102 and the handgrip 106.

Operation of the upright type cleaner in accordance with the conventional art will be explained. First, the electric wire 126 is separated from the supporter 124 thus to insert the socket outlet 128 into the plug (not shown) mounted at a wall surface, and then the power switch 120 mounted at the body 102 is turned on. According to this, a suction motor is driven thus to generate a suction force, thereby sucking dust and foreign materials of the floor into the suction head 102 and being collected in the filter mounted at the body 102 through the suction hose 110.

Once the cleaner is operated, the user grips the handgrip 106 thus to move the cleaner back and forth under a state that the body 102 is inclined with an angle for the user to easily clean, thereby performing a cleaning.

However, in the conventional upright type cleaner, since the power switch 120 is mounted at the body 102, the user has an inconvenience in searching for the power switch 120 at the time of turning on/off a power of the cleaner. Also, when a power of the cleaner is to be turned off for a minute while cleaning, the power switch 120 mounted at the body 102 has to be searched to operate the cleaner, thereby having a difficulty in using the cleaner.

SUMMARY OF THE INVENTION

Therefore, an object of the present invention is to provide an upright type cleaner capable of easily performing a cleaning by automatically turning on a power without a user's additional handle at the time of starting a cleaning and by automatically turning off a power at the time of finishing a cleaning.

To achieve these and other advantages and in accordance with the purpose of the present invention, as embodied and broadly described herein, there is provided an upright type cleaner comprising: a body provided with a handgrip at an upper side thereof; a suction head positioned at a lower side of the body and hinge-connected to the body, for sucking dust and foreign materials of a floor; and a power ON/OFF unit disposed between the body and the suction head for turning off a power when the body is uprighted and turning on the power when the body is inclined.

The power ON/OFF unit includes: a power switch disposed at a lower side of the body for turning on/off a power of the cleaner; and an operation protrusion disposed at one side of the suction head facing the power switch for turning on the power switch when the body is inclined, and turning off the power switch when the body is uprighted.

The upright type cleaner comprises: a body provided with a handgrip at an upper side thereof; a suction head positioned at a lower side of the body and hinge-connected to the body, for sucking dust and foreign materials of a floor; a first power ON/OFF unit disposed between the body and the suction head for turning off a power when the body is uprighted and turning on the power when the body is inclined; and a second power ON/OFF unit for turning on the power of the cleaner when a suction hose is separated from the suction head for another cleaning operation of the cleaner.

The second power ON/OFF unit includes: a second power switch mounted at an upper surface of the suction head to which the suction hose is connected; and a second operation protrusion protruded at an outer circumference surface of one end portion of the suction head connected to a connection pipe of the suction head, for turning on the power of the cleaner by pushing the second power switch when the suction hose is separated form the connection pipe of the suction head, and turning off the power of the cleaner by pushing the second power switch when the suction hose is connected to the connection pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, one embodiment of an upright type cleaner according to the present invention will be explained with reference to the attached drawings.

Even if there may exist a plurality of preferred embodiments of the upright type cleaner according to the present invention, the most preferable embodiment will be explained hereinafter.

Figure 1:
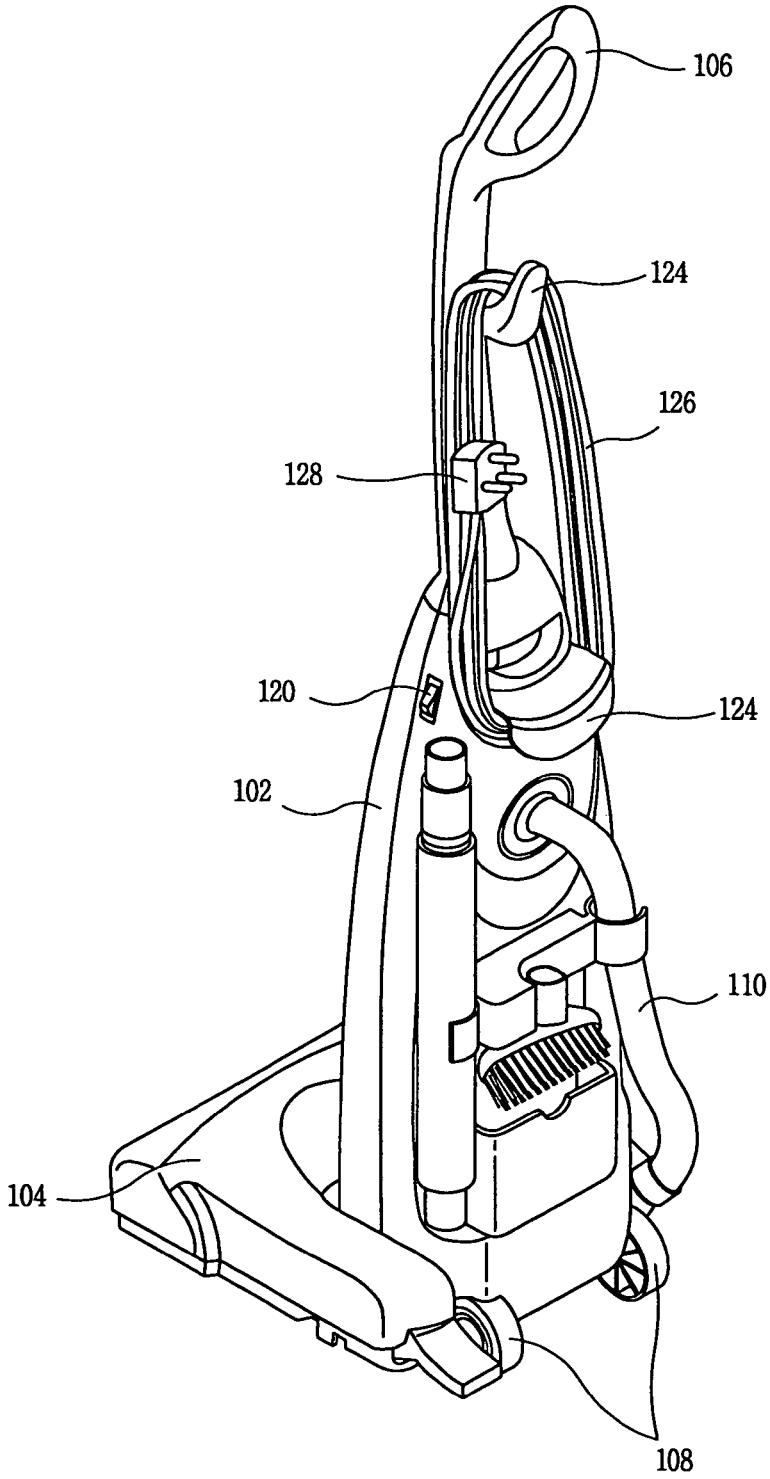
FIG. 1 CONVENTIONAL ART
FIG. 1 is a perspective view showing an upright type cleaner in accordance with the conventional art.
Figure 2:
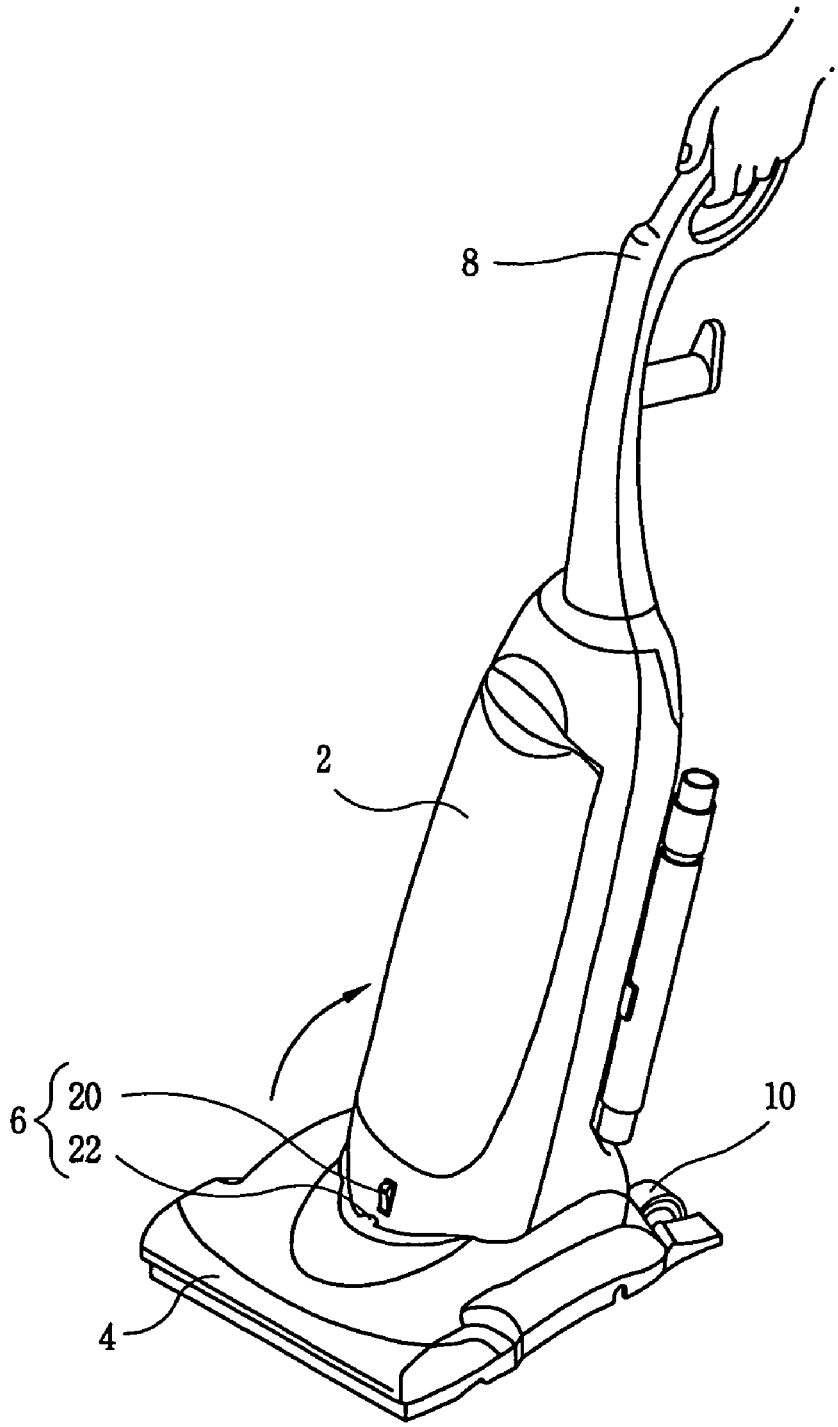
FIG. 2 is a perspective view of an upright type cleaner according to one embodiment of the present invention.

FIG. 2 is a perspective view of an upright type cleaner according to one embodiment of the present invention.

The upright type cleaner according to the present invention comprises: a body 2 disposed with an upright state; a suction head 4 positioned at a lower side of the body 2 and hinge-connected to the body 2, for sucking dust and foreign materials of a floor; and a power ON/OFF unit 6 disposed between the body 2 and the suction head 4 for turning off a power when the body is uprighted in order to keep the cleaner after the cleaning and turning on the power when the body is inclined with a certain angle in order to perform the cleaning.

A suction motor (not shown) for generating a suction force, a filter (not shown) for collecting dust or foreign materials by a suction force generated from the suction motor, and etc. are mounted in the body 102. A handgrip 8 gripped by the user is detachably disposed at an upper side of the body 2.

A moving wheel 10 for moving the cleaner is mounted at the suction head 4.

Figure 3:
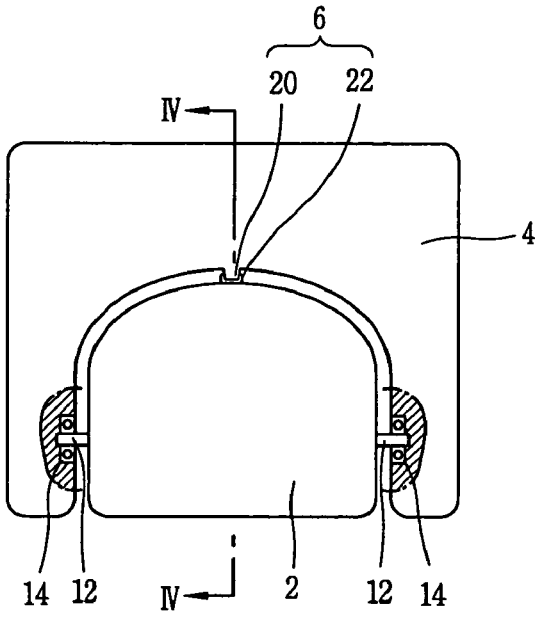
FIG. 3 is a cross-section view of the upright type cleaner according to one embodiment of the present invention.

As shown in FIG. 3, a hinge shaft 12 is connected to both lateral surfaces of the lower side of the body 2, and a hinge groove 14 for rotatably supporting the hinge shaft 12 is formed at both inner lateral surfaces of the suction head 4.

Figure 4:
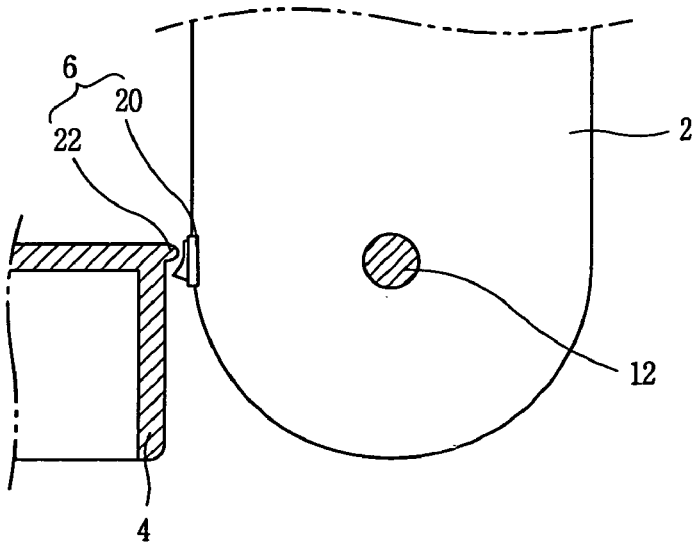
FIG. 4 is a sectional view taken along line IV-IV of FIG. 3.
Figure 5:
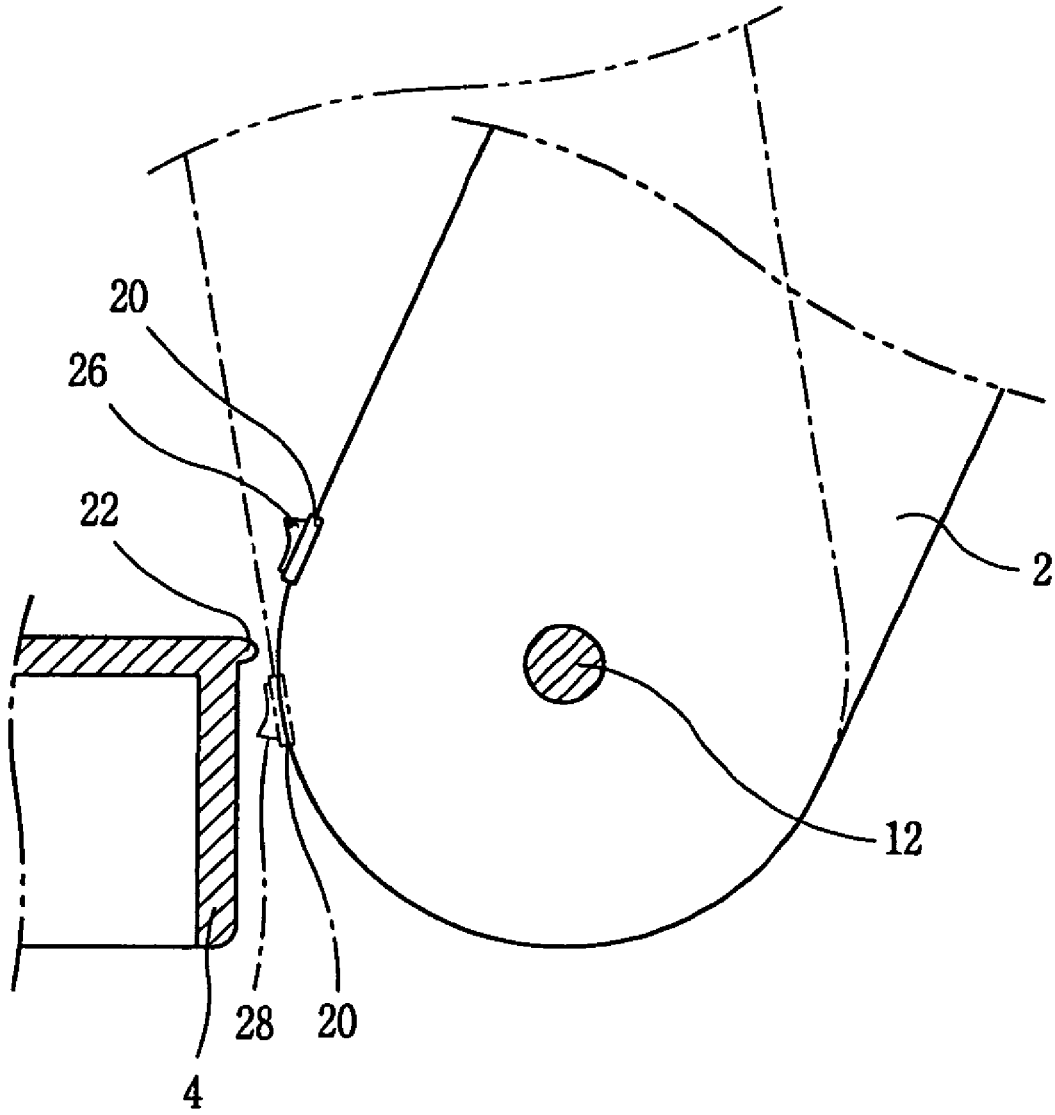
FIG. 5 is an operation state view of the upright type cleaner according to one embodiment of the present invention.

FIG. 4 is a sectional view taken along line IV-IV of FIG. 3 showing a power ON/OFF unit of the upright type cleaner, and FIG. 5 is an operation state view showing the ON/OFF unit of the upright type cleaner according to one embodiment of the present invention.

The power ON/OFF Unit 6 includes: a power switch 20 disposed at a front side of a lower side of the body 2 for turning on/off a power of the cleaner; and an operation protrusion 22 protruded at an inner lateral surface of the suction head 4 facing the power switch 20 for turning on the power switch 20 when the body 2 is inclined with a certain angle and turning off the power switch 20 when the body 2 is uprighted.

The power switch 20 is composed of a first button portion 26 pressed by the operation protrusion 22 when the body 2 is uprighted; and a second button portion 28 pressed by the operation protrusion 22 when the body 2 is inclined with a certain angle by being rotated on the basis of the hinge shaft 12 for the cleaning.

The operation protrusion 22 is protruded at the inner side surface of the suction head 4 facing the power switch 20 with a certain width.

Operation of the power ON/OFF unit according to one embodiment of the present invention will be explained, In case that a cleaning is not performed, the body 2 is positioned at the suction head 4 with an upright state. Herein, the operation protrusion 22 formed at the suction head 4 presses the first button portion 26 of the power switch 20 mounted at the body 2 thus to maintain the power OFF state of the cleaner.

Under this state, if the user grips the handgrip 8 for the cleaning thus to incline the body 2 with a certain angle against the suction head 4, the power switch 20 installed at the body 2 is rotated thus to be stepped by the operation protrusion 22 and the second button portion 28 is pressed thus to turn on the power of the cleaner. According to this, the power is supplied to the cleaner thus to perform the cleaning. After the cleaning, the body 2 is uprighted, so that the power switch 20 is rotated in the opposite direction to the direction of the above process. According to this, the first button portion 26 is pressed by the operation protrusion 22 thus to turn off the power of the cleaner.

Figure 6:
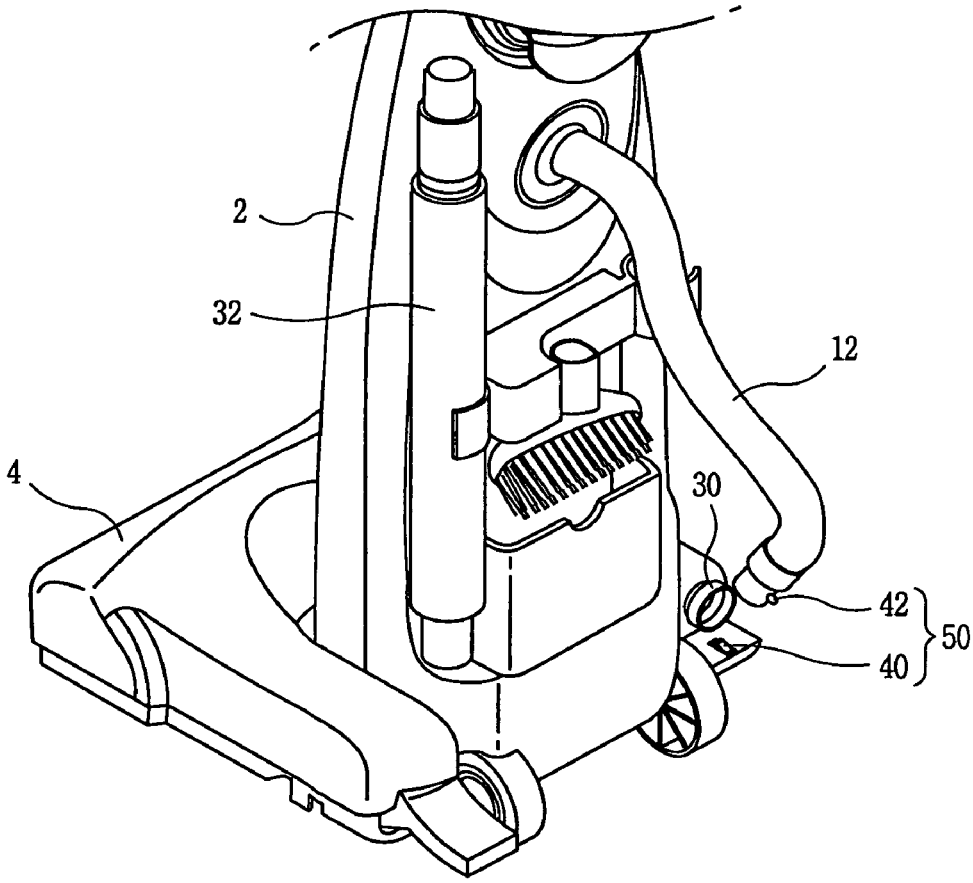
FIG. 6 is a perspective view showing an upright type cleaner according to a second embodiment of the present invention.
Figure 7:
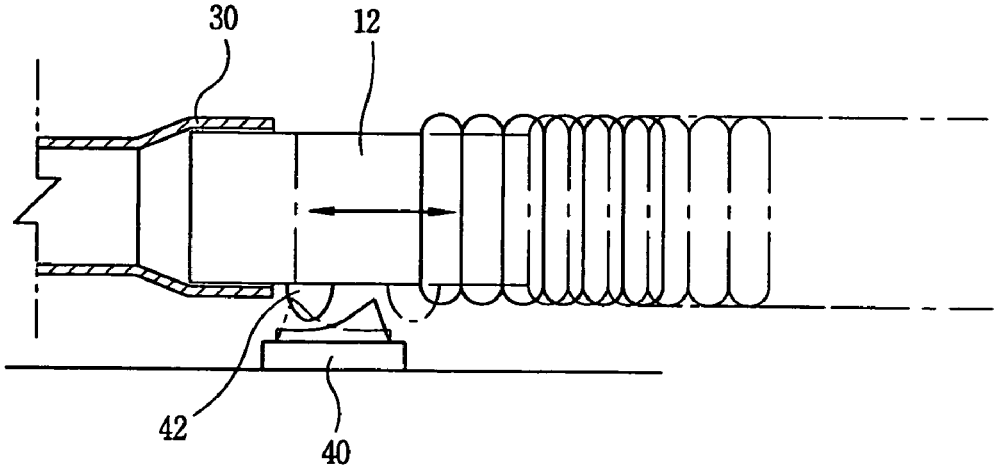
FIG. 7 is a sectional view showing a second power ON/OFF unit of the upright type cleaner according to the second embodiment of the present invention.

FIG. 6 is a perspective view showing an upright type cleaner according to a second embodiment of the present invention.

In the upright type cleaner according to the second embodiment, a suction hose 12 is connected between the suction head 4 and the body 2 thus to perform a floor cleaning that dust sucked to the suction head 4 is collected to the filter of the body 2, and the suction hose 12 is separated from the suction head 4 thus to connect an extension pipe 32 to the suction hose 12. Also, an additional cleaner tool is mounted at the extension pipe 32 thus to perform a cleaning except the floor cleaning.

A power ON/OFF unit applied to the upright type cleaner according to the second embodiment of the present invention includes: a first power ON/OFF unit 6 disposed for turning off a power when the body 2 is uprighted and turning on the power when the body 2 is inclined; and a second power ON/OFF unit 50 for turning on the power of the cleaner when the suction hose 12 is separated from the suction head 4 for another cleaning operation of the cleaner.

The first power ON/OFF unit 6 includes: a first power switch disposed at a front side of a lower side of the body 2 for turning on/off a power of the cleaner; and a first operation protrusion 22 protruded at the inner side surface of the suction head 4 facing the first power switch 20 for turning on the first power switch 20 when the body 2 is inclined with a certain angle and turning off the first power switch 20 when the body 2 is uprighted.

The first power ON/OFF unit 6 has the same construction and operation as the power ON/OFF unit explained in the first embodiment.

The second power ON/OFF unit 50 turns on/off the power of the cleaner when the upright type cleaner performs another cleaning operation.

That is, the second power ON/OFF unit 50 includes: a second operation protrusion 42 protruded at an outer circumferential surface of one end portion of the suction hose 12 connected to the suction head 4; and a second power switch 40 mounted at an upper surface of the suction head 4 facing the operation protrusion 42 for turning on the power by the second operation protrusion 42 when the suction hose is separated from a connection pipe 30 of the suction head 4, and turning off the power by the second operation protrusion 42 when the suction hose 12 is inserted into the connection pipe 30 of the suction head 4.

Operation of the second power ON/OFF unit 50 will be explained. Under a state that the suction hose 12 is connected to the connection pipe 30 of the suction head 4, the second power switch 40 maintains an OFF state. When the suction hose 12 is separated from the connection pipe 30 for another cleaning operation except the floor cleaning, the second operation protrusion 42 formed at the suction hose 12 presses the second power switch 40 mounted at the upper surface of the suction head 4. According to this, the second power switch 40 is turned on thereby to apply a power to the cleaner. Then, the cleaner performed another cleaning operation except the floor cleaning. When said another cleaning operation is completed, the suction hose 12 is inserted into the connection pipe 30. According to this, the operation protrusion 42 formed at the suction hose 12 presses the power switch thus turn off the power.

Herein, when either the first power switch 20 or the second power switch 40 is turned on, the power is applied to the cleaner.

That is, the second power switch 20 maintains the OFF state at the time of the floor cleaning, and at the time of another cleaning operation except the floor cleaning, the body 2 maintains the uprighted state thus to turn off the first power switch 20 and turn on the second power switch 40.

In the upright type cleaner according to the present invention, the power switch mounted at the body is turned on by the operation protrusion formed at the suction head when the user inclines the body for the cleaning, thereby supplying the power to the cleaner. Also, when the body is uprighted after completing the cleaning, the power switch is turned off by the operation protrusion thus to shield the power to be supplied to the cleaner, thereby automatically turning on/off the power without the user's additional handling.

Also, when the suction hose is separated from the suction head for another cleaning operation except the floor cleaning, the power of the cleaner is turned on thereby not to require an additional on/off operation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An upright type cleaner comprising:

a body provided with a handgrip at an upper side thereof;

a suction head positioned at a lower side of the body and hinge-connected to the body, for sucking dust and foreign materials of a floor;

a first power ON/OFF unit disposed between the body and the suction head for turning off a power when the body is uprighted and turning on the power when the body is inclined; and a second power ON/OFF unit for turning on the power of the cleaner when a suction hose is separated from the suction head for another cleaning operation of the cleaner.

2. The upright type cleaner of claim 1, wherein the first power ON/OFF unit includes:

a first power switch disposed at a lower side of the body for turning on/off a power of the cleaner; and a first operation protrusion disposed at one side of the suction head facing the first power switch for turning on the first power switch when the body is inclined against the suction head and turning off the first power switch when the body is uprighted.

3. The upright type cleaner of claim 2, wherein the first power switch is composed of:

a first button portion pressed by the first operation protrusion thus to turn off the power of the cleaner when the body is uprighted; and a second button portion pressed by the first operation protrusion thus to turn on the power of the cleaner when the body is inclined with a certain angle for a cleaning.

4. The upright type cleaner of claim 2, wherein the first operation protrusion is protruded with a certain width at an inner side surface of the suction head to face the first power switch.

5. The upright type cleaner of claim 1, wherein the second power ON/OFF unit includes:

a second power switch mounted at an upper surface of the suction head to which the suction hose is connected; and a second operation protrusion protruded at an outer circumference surface of one end portion of the suction head connected to a connection pipe of the suction head, for turning on the power of the cleaner by pushing the second power switch when the suction hose is separated form the connection pipe of the suction head and turning off the power of the cleaner by pushing the second power switch when the suction hose is connected to the connection pipe.

6. The upright type cleaner of claim 2 or 5, wherein the power of the cleaner is turned on by turning on either the first power switch or the second power switch.

* * * * *